US007140408B1

(12) United States Patent
Hinchliff et al.

(10) Patent No.: US 7,140,408 B1
(45) Date of Patent: Nov. 28, 2006

(54) KNIFE ASSEMBLY AND CHIPPING KNIFE THEREFOR

(75) Inventors: Thomas Charles Hinchliff, Lake Oswego, OR (US); Jianmin Liao, Tigard, OR (US)

(73) Assignee: Key Knife, Inc., Tualatin, OR (US)

( * ) Notice: Subject to any disclaimer, the term of this patent is extended or adjusted under 35 U.S.C. 154(b) by 0 days.

(21) Appl. No.: 11/347,472

(22) Filed: Feb. 3, 2006

(51) Int. Cl.
*B27C 1/00* (2006.01)

(52) U.S. Cl. ..... 144/241; 144/176; 144/230; 144/235; 144/218; 407/47

(58) Field of Classification Search ..... 144/176, 144/218, 230, 241, 235, 162.1, 175, 174; 241/92, 298, 189.1, 228.1, 296; 407/40, 407/42, 47, 113–116
See application file for complete search history.

(56) References Cited

U.S. PATENT DOCUMENTS

| | | | | |
|---|---|---|---|---|
| 3,981,337 | A | 9/1976 | Sundstrom | |
| 4,047,670 | A | 9/1977 | Svensson | |
| 4,669,516 | A * | 6/1987 | Carpenter et al. | 144/241 |
| 4,754,789 | A * | 7/1988 | Jonsson | 144/241 |
| 5,348,065 | A | 9/1994 | Meyer | |
| 5,649,579 | A * | 7/1997 | Kokko et al. | 144/176 |
| 5,819,826 | A | 10/1998 | Schmatjen | |
| 6,951,313 | B1 | 10/2005 | Frick et al. | |
| 6,968,879 | B1 * | 11/2005 | Schuh et al. | 144/174 |
| RE38,930 | E | 1/2006 | Swartwood et al. | |
| 2003/0131907 | A1 * | 7/2003 | Biller et al. | 144/241 |

FOREIGN PATENT DOCUMENTS

| | | |
|---|---|---|
| EP | 1 329 295 | 7/2003 |

* cited by examiner

*Primary Examiner*—Bena Miller
(74) *Attorney, Agent, or Firm*—Birdwell & Janke, LLP

(57) ABSTRACT

A knife assembly and chipping knife therefor. The knife assembly includes a knife, and employs an upper clamping member and a lower clamping member for clamping the knife therebetween. The knife has an elongate axis and two spaced apart cutting edges parallel to the elongate axis and defining a first reference plane. The knife is further defined by a plane of reflective symmetry that is perpendicular to the first reference plane and which contains the elongate axis. The knife has a front side and a back side spaced from the front side. The front and back sides terminate in the cutting edges. A deflector ridge projects from the front side and reaches a point of greatest maximum projection of the knife from the first reference plane, the point lying in the plane of reflective symmetry.

37 Claims, 6 Drawing Sheets

KNIFE ASSEMBLY AND CHIPPING KNIFE THEREFOR

FIELD OF THE INVENTION

The present invention relates to a knife assembly and chipping knife therefor, which is primarily used for cutting chips or flakes from logs.

BACKGROUND

In the use of cutting apparatus for processing logs to usable lumber, the log is forced into contact with a rotating cutting head of the apparatus that typically carries a plurality of removably clamped, elongate knives. The cutting head to which the knives are clamped typically falls into one of three classes of head shape, known in the art as disc, drum, and conical.

The apparatus spins at a relatively high rate compared to the rate of feed of the log, so that a single encounter between one of the knives of the apparatus and the log results in the displacement and removal of a relatively small portion of the log. With variations resulting from the variations in the rate of rotation relative to the rate of feed, the head geometry and the shape and configuration of the knives, this small portion is what is generally referred to in the art as a "chip" or a "flake" (hereinafter "chip") of more or less controlled dimensions. The chip often has commercial value in itself and is not simply waste material, as it can be used in the production of manufactured wood products such as oriented strand board.

Typically, the cutting head rotates at thousands of revolutions per minute, so each chip is removed quickly, resulting in large forces being applied to the knives. To maintain chip quality, it is important to maintain the position of the knives against these forces. So the prior art has provided numerous knife shapes, typically defined in cross-sections perpendicular to the elongate axes of the knives, that work in cooperation with the clamping members to help secure the knives. For use in disc style cutting heads, the knives are often double-sided, providing two parallel cutting edges on either side of the knife. This allows turning the knife to expose a fresh cutting edge when the exposed cutting edge becomes worn.

Schmatjen, U.S. Pat. No. 5,819,826, assigned to Key Knife, Inc. of Tualatin, Oreg., describes a double-sided knife having what have often been referred to as a pair of "deflector ridges" on the bottom side of the knife, i.e., the side of the knife that faces in the direction of rotation of the cutting head. The deflector ridges project from the bottom side of the knife and therebetween form, essentially, a keyway or channel that indexes the knife to a suitably shaped inner clamping member that receives the bottom side of the knife. This indexing is an example of shaping the knife in cooperation with the clamping members to stabilize the position of the knife in the apparatus, and it also provides for easy installation of the knife into proper position.

Outer, curved transition portions of the deflector ridges further provide for guiding the flow of chips cut from the knife away from the cutting edge in such manner as to avoid damaging the chips as well as to efficiently "exhaust" the chips from the apparatus so that the required flow of material past the cutting edge is facilitated or at least not impeded.

The knife of the '826 patent has a plane of symmetry (lying mid-way between the deflector ridges) such that the knife may be turned end-for-end to expose the alternate cutting edge.

Frick et al., U.S. Pat. No. 6,951,313 shows a double-sided knife having two spaced-apart projections, where one of the projections extends from the top side of the knife, i.e., the side of the knife that faces away from the direction of rotation of the cutting head, and the other extends from the bottom side of the knife. It can be roughly compared in general configuration, for present illustrative purpose, to the knife of the '826 patent, cut along its plane of symmetry into two facing halves, where one of the halves is flipped 180 degrees. Thus, to expose the alternate cutting edge, the knife of the '313 patent is turned 180 degrees about its elongate axis instead of end-for-end. Aside from this difference, the configuration provides no apparent purpose, and it has the disadvantage that one of the projections is always non-functional and therefore is simply dead weight.

While a number of different knife configurations have been proposed, that of the '826 patent has been at least one of the most commercially successful because it provides a number of operational and manufacturing advantages. However, there remains a need for a knife assembly and chipping knife therefore providing for further improvements over the prior art.

SUMMARY

A knife assembly and chipping knife therefor. A knife assembly includes a knife, and employs an upper clamping member and a lower clamping member for clamping the knife therebetween.

The knife has an elongate axis and two spaced apart cutting edges parallel to the elongate axis and defining a first reference plane. The knife is further defined by a plane of reflective symmetry that is perpendicular to the first reference plane and which contains the elongate axis. The knife has a front side and a back side spaced from the front side. The front and back sides terminate in the cutting edges. A deflector ridge projects from the front side and reaches a point of greatest maximum projection of the knife from the first reference plane, the point lying in the plane of reflective symmetry.

Preferably, the knife assembly further includes a base, where the lower clamping member is adapted for disposition between the base and the lower clamping member, where the lower clamping member provides for pivotal movement about the base relative to the upper clamping member.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Figure 1:
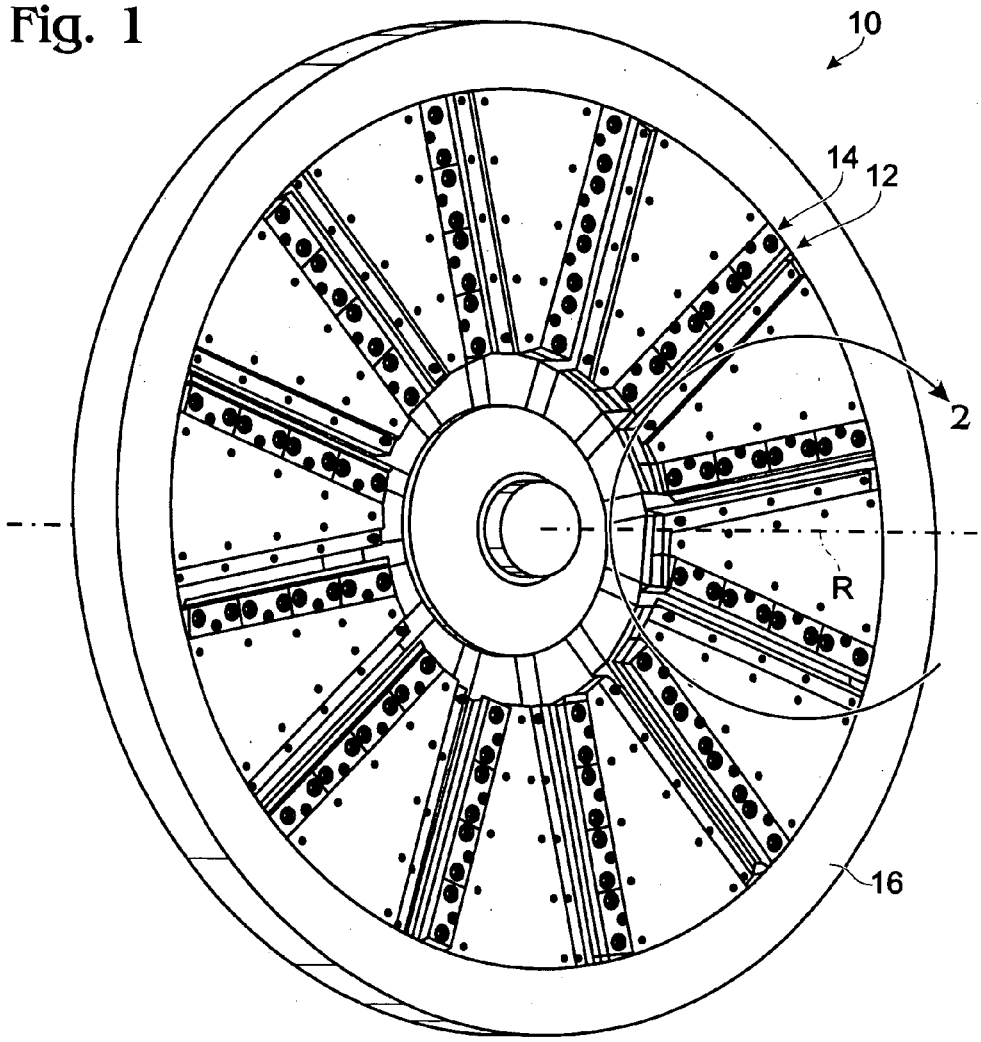
FIG. 1 is a side elevation of a chipper disc incorporating a plurality of knives according to the present invention.

Reference will now be made in detail to specific preferred embodiments of the invention, examples of which are illustrated in the accompanying drawings. Wherever possible, the same reference numbers are used in the drawings and the description to refer to the same or like parts or dimensions.

For purposes herein, chips, flakes, and other such terms used to describe portions of logs or lumber removed by cutting apparatus as have been described above are intended to fall within the meaning of the term "chips," where the cutting that produces these portions is referred to as "chipping," with no loss of generality intended. Thus, it is to be understood that knives according to the invention may be used, with suitable modification, in, e.g., chipper or chipping discs, waferizers, drum chippers or flakers, ring slicers, conical chippers or canters, and any similar cutting apparatus used in the wood processing industry. Further, such knives may be used in chipping apparatus adapted for chipping materials other than wood.

Figure 2:
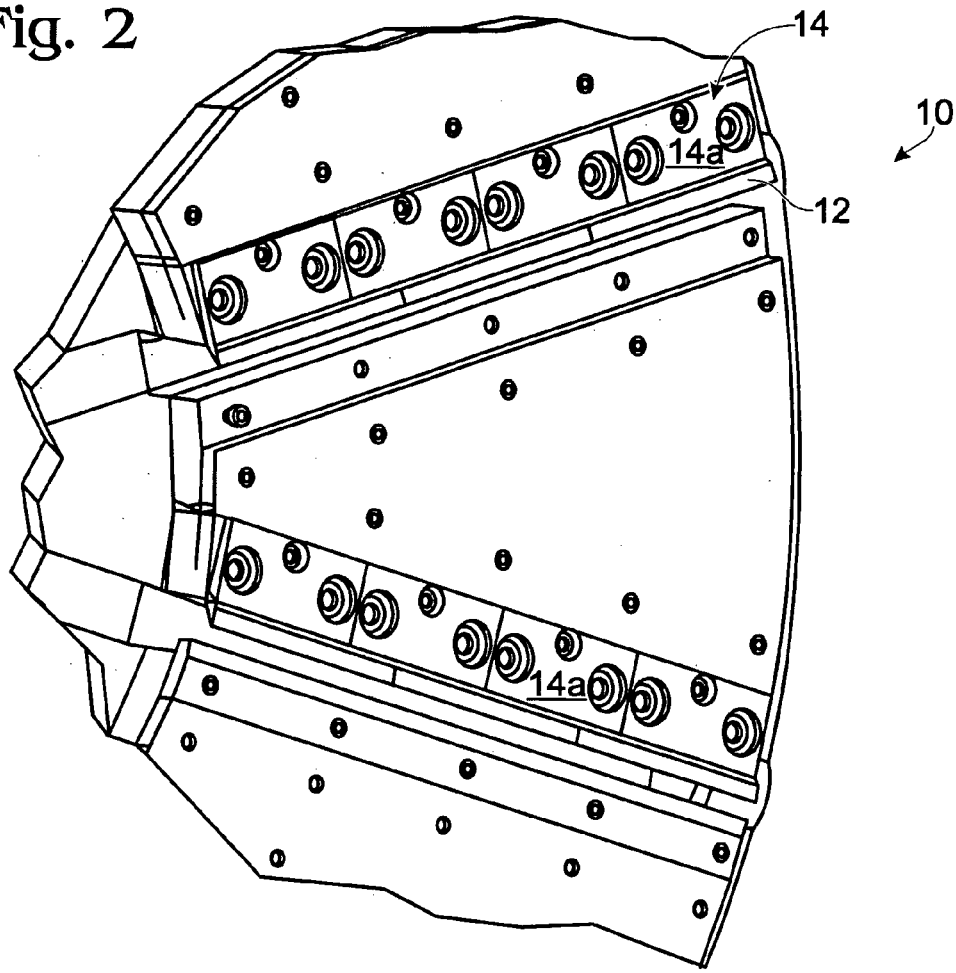
FIG. 2 is the detail circle referenced in FIG. 1, above, as 2–2.

As an exemplary context for use of chipping knives according to the invention, FIGS. 1 and 2 show a disc chipper 10. On the side of the chipper 10 are a plurality of chipping knives 12 and associated clamps 14 for removably clamping the knives 12 to a cutting head 16 of the chipper 10. The cutting head 16 rotates about an axis of rotation "R," causing each knife 12 to sweep out an annular space.

Figure 3:
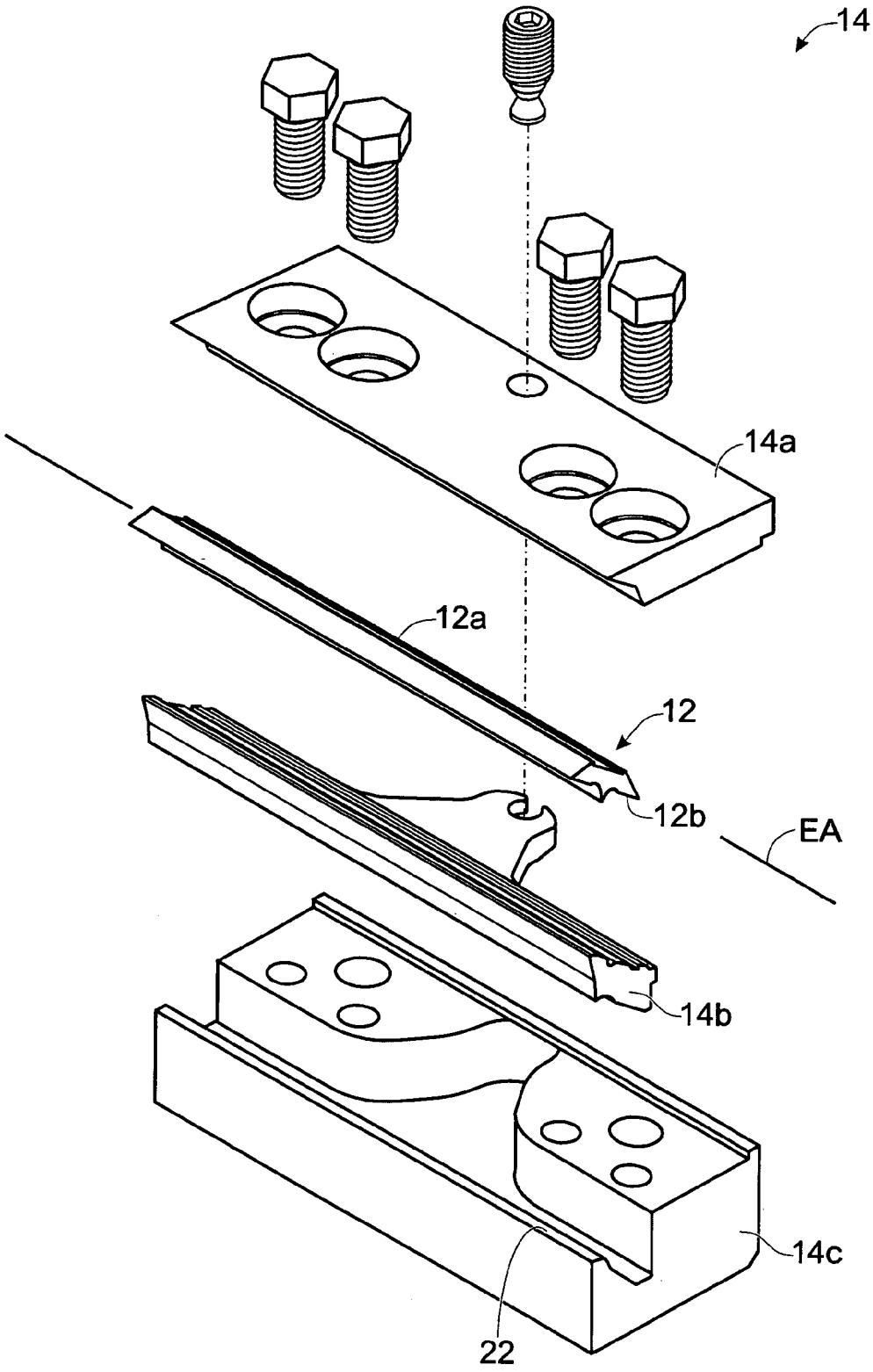
FIG. 3 is an exploded pictorial view of a preferred clamp for clamping one of the knives of the chipper disc of FIG. 1.

As best seen in FIG. 3, showing an exploded view of the clamps 14, the clamps 14 typically include an upper clamping member 14*a* and a lower clamping member 14*b*, the latter often referred to in the art as a "counterknife." The upper and lower clamping members receive respective back and front sides 12*a*, 12*b* of the associated knife 12.

FIG. 3 shows a preferred embodiment for clamping the knives 12 in which each clamp 14 includes a base 14*c* which is bolted to the cutting head 16, and the lower clamping member 14*b* is disposed between the base and the upper clamping member 14*a*. Further, preferably, the lower clamping member 14*b* is adapted for pivotal adjustment about a pivot 22 of the base 14*c*.

Figure 4:
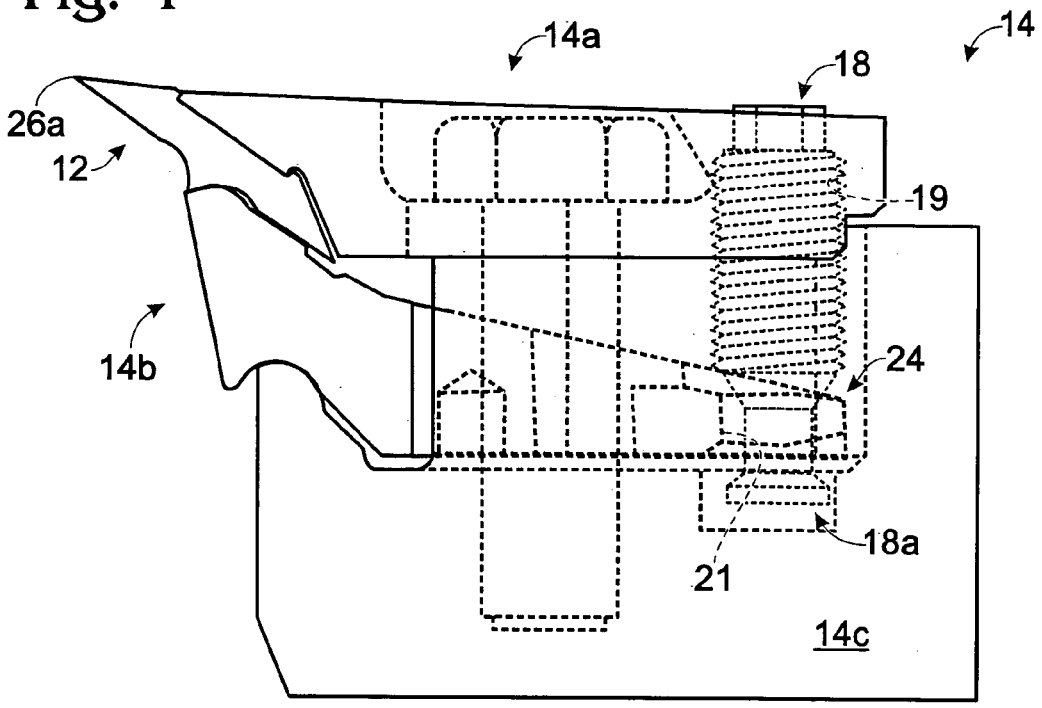
FIG. 4 is a side elevation of the clamp of FIG. 3, showing a lower clamping member, a knife, and an upper clamping member, with the lower clamping member pivoted away from the upper clamping member.
Figure 5:
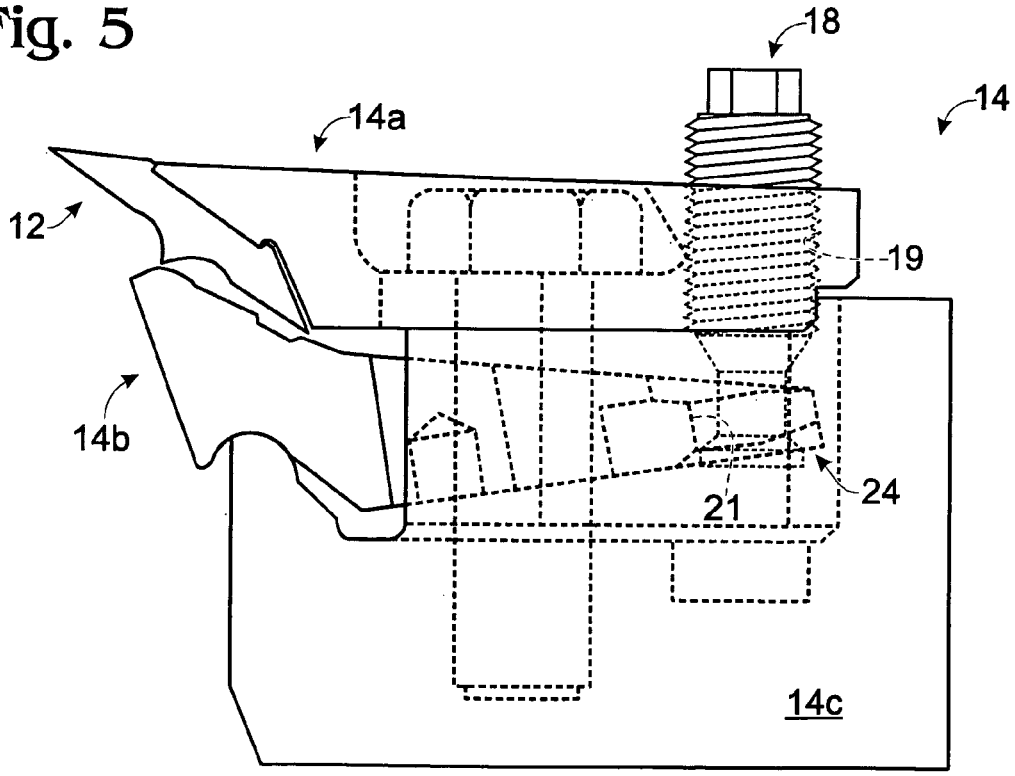
FIG. 5 is a side elevation of the clamp of FIG. 4, showing the lower clamping member pivoted toward the upper clamping member, for clamping the knife between the two clamping members.

The action can be seen by comparing FIGS. 4 and 5. An adjustment bolt 18 is threadingly received in a through-hole 19 of the upper clamping member 14*a*, and an end 18*a* of the bolt is captured in a through-hole 21 of an end 24 of the lower clamping member 14*b*. The lower clamping member 14*b* is supported by the bolt 18 at the end 24, and by the base 14*c* at the pivot 22.

Turning the bolt 18 raises or lowers the bolt with respect to the upper clamping member 14*a*, taking the end 24 of the lower clamping member with it. The lower clamping member 14*b* thus pivots about the pivot 22 with movement of the bolt 18.

In FIG. 3, an elongate configuration of the knife 12 can be seen, the knife therefore having an elongate axis "EA." FIGS. 4 and 5 view the knife 12 in a direction parallel to the axis EA.

In FIG. 4, the knife 12 is clamped between the upper and lower clamping members 14*a*, 14*b*. In FIG. 5, the lower clamping member 14*b* has been pivoted about the pivot point 22 so as to drop the knife 12 down and away from the upper clamping member. The knife is no longer clamped, and is easily accessible and held in a convenient position for removal.

While providing the aforedescribed pivoting function is preferred, it is not essential for use of the knife 12.

Figure 8:
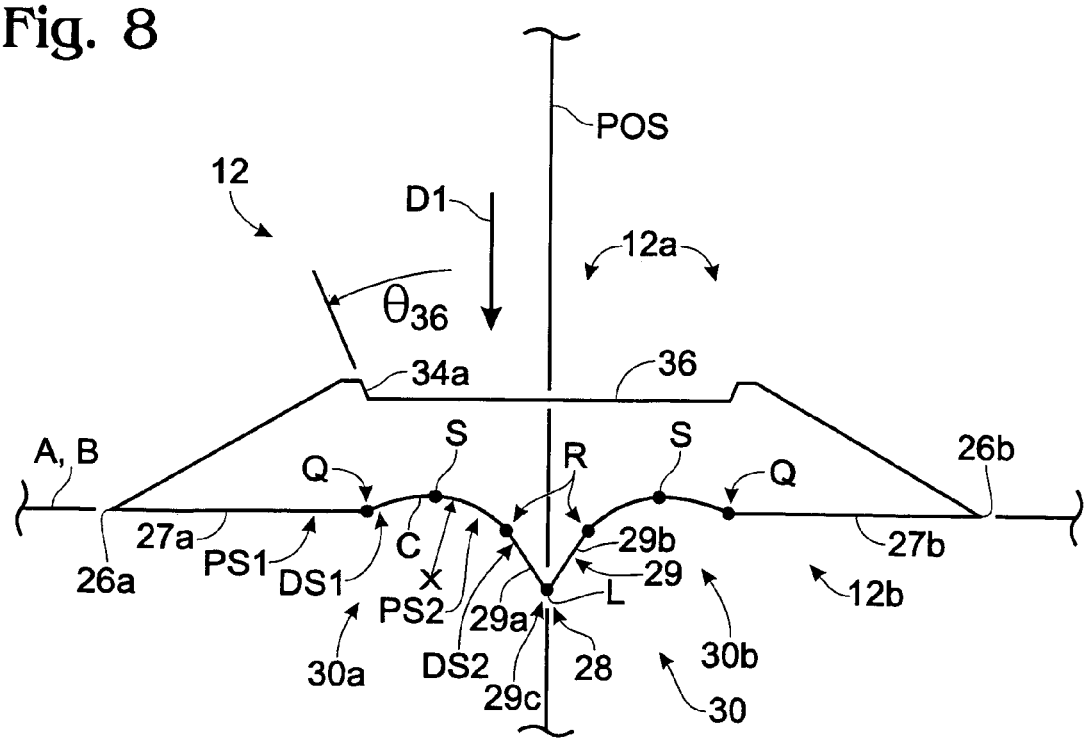
FIG. 8 is an end view of the knife of FIGS. 6 and 7.
Figure 6:
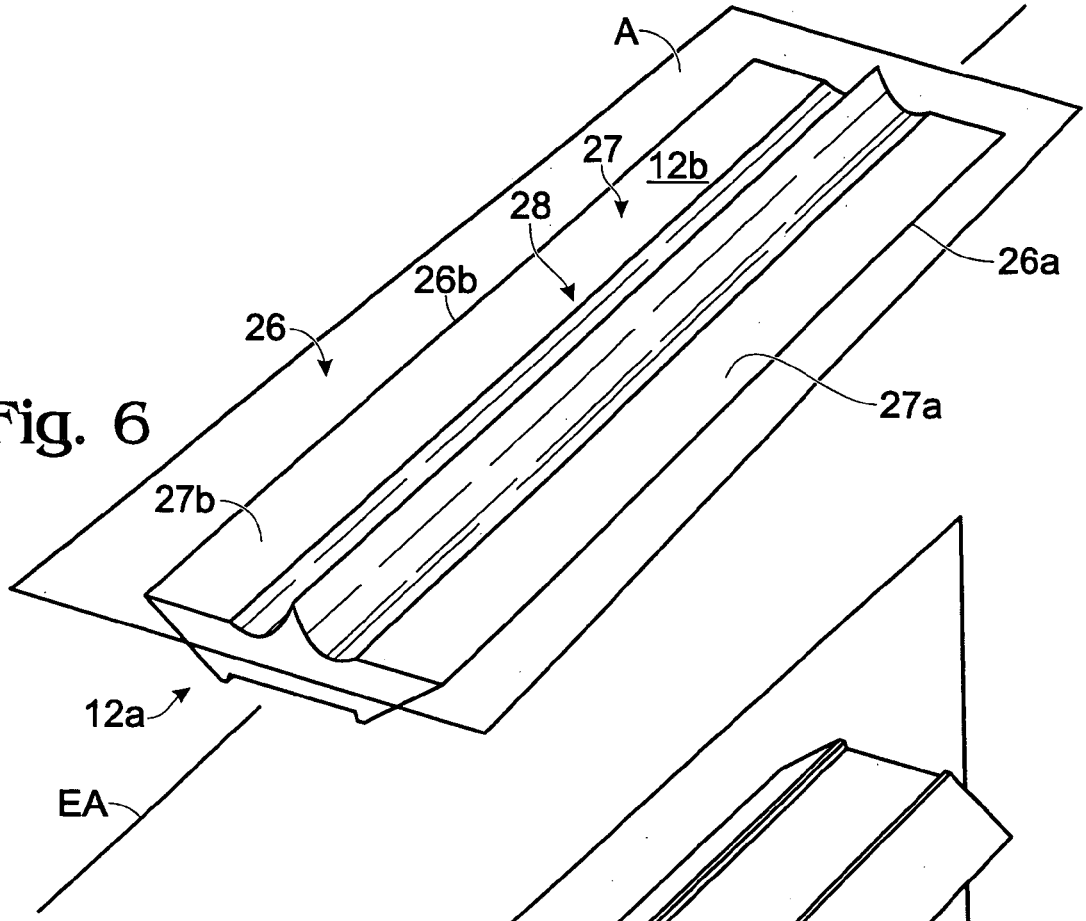
FIG. 6 is a back-side perspective view of the knife of FIGS. 4 and 5.
Figure 7:
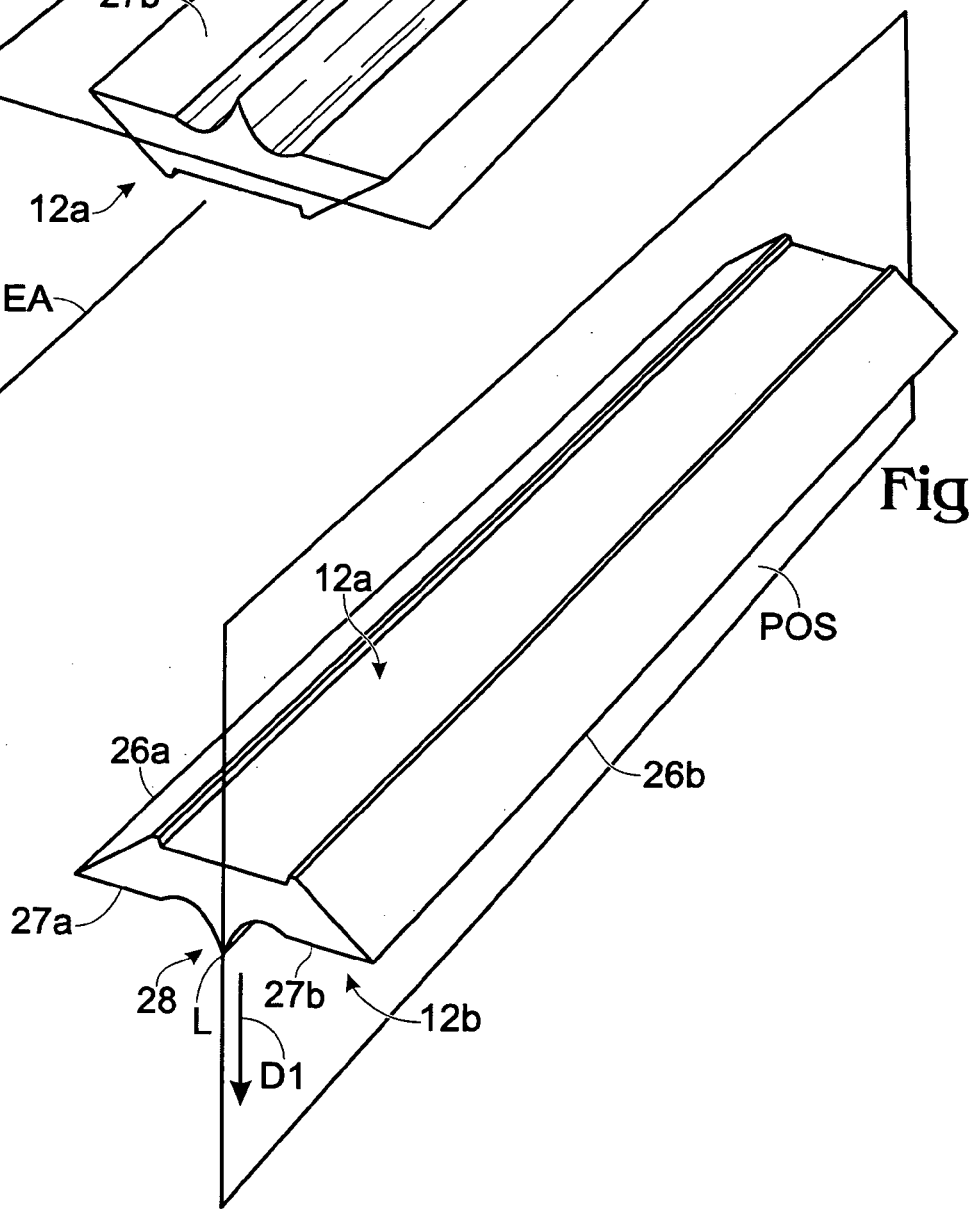
FIG. 7 is a front-side perspective view of the knife of FIG. 6.

The knife 12 is shown in perspective in FIGS. 6 and 7, and in end view in FIG. 8. The knife has two cutting edges 26 lying in a reference plane "A," the edges referenced as 26*a* and 26*b*. The front side 12*b* includes two substantially planar knife-edge-joining portions 27, namely 27*a* and 27*b* that may also lie in the plane A, but which may be disposed at non-zero angles with respect to the plane A if desired. For example, even if the knife-edge-joining portions are originally provided to lie in the plane A, these surfaces may be ground as known in the art to alter the attack angle of the knife 12.

Between the knife-edge-joining portions 27, and projecting from the front side 12*b* of the knife 12, is a single deflector ridge 28. The deflector ridge 28 reaches a linear edge or line of points "L" of greatest maximum projection of the knife in the direction "D1" indicated by the arrow (FIG. 7), from the plane A, the line lying in a plane of reflective symmetry "POS" of the knife. The plane of reflective symmetry is perpendicular to the plane A and parallel to the elongate axis EA of the knife. With this symmetry, the knife 12 can be removed from the apparatus when it is in the configuration shown in FIG. 5, turned end-for-end to provide a fresh cutting edge, and reinstalled.

With particular reference to FIG. 8, the deflector ridge 28 has two canted outer surfaces 29, namely 29*a* and 29*b*, joining at an apex 29*c* that is preferably sharp, but which in typical practice is slightly rounded-off, and where the amount of such rounding is not particularly important. The outer surfaces 29 may be substantially planar as shown, or may be concave and, preferably, smoothly curving.

The deflector ridge 28 provides, in the outer surfaces 29, a guiding surface for efficiently guiding cut chips away from the apparatus. This guiding action also protects the lower clamping member 14*b* from wear as a result of preventing contact with the chips that would otherwise occur. Further, a single deflector ridge may be made larger than the corresponding deflector ridges of a pair without any additional metal being required. This provides for a stronger deflector ridge that is also more capable of providing the aforedescribed functions with no increase in the weight of the knife 12. It also provides for a stronger knife by distributing more metal farther from the neutral axis, as in an I-beam.

Figure 9:
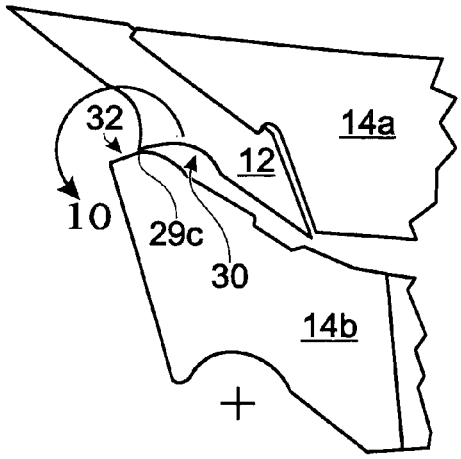
FIG. 9 is a side elevation of the clamp of FIG. 4, showing the lower clamping member pivoted to a position of close proximity to the knife.

With particular reference to FIG. 8, preferably, the front side 12*b* of the knife 12 also includes a pair of indexing features 30, namely 30*a* and 30*b*, as will be described. The indexing features 30 help, along with the deflector ridge 28, to index the knife to the lower clamping member 12*b*. With reference to FIG. 9, the indexing features 30 of the knife cooperate with a complementary indexing feature 32 of the lower clamping member, and the features 30 and 32 may be provided with many alternative complementary shapes and dispositions to serve the purpose of providing for knife indexing. However, preferably, the indexing features 30 and 32 have specific shapes and dispositions for serving additional purposes as described below.

Turning back to FIG. 8, each indexing feature 30 is disposed between the corresponding knife-edge-joining portion 27*a*, 27*b* and the deflector ridge 28. That is, distal sides "DS1" of the indexing features 30 merge with proximal sides "PS1" of the knife-edge-joining portions 27 at points "Q," and proximal sides "PS2" of the indexing features 30 merge with distal sides "DS2" of the outer surfaces 29 of the deflector ridge 28 at points "R."

Due to the symmetry of the knife, the points Q on both sides of the plane of symmetry POS define a plane "B," which in this example is coincident with the plane A but need not be as mentioned above. The indexing features describe re-entrant contours "C" that, aside from intersecting the plane B at the points Q, are otherwise substantially disposed below the plane B in the direction D1. Points "S" on these contours are points of minimum projection of the front side 12*b* of the knife in the direction D1.

This re-entrant disposition of the indexing features 30 provides the advantage of tucking the features up and out of the way of chip flow so that, as the knife-edge-joining portions wear, the indexing features remain in substantially un-worn condition.

Further, each contour C is preferably shaped as a concave, smoothly varying arc that smoothly merges with the corresponding outer surface 29*a*, 29*b* of the deflector ridge 28. In correspondence, the complementary feature 32 of the lower clamping member 12*b* is a convex, smoothly varying arc, as shown in FIG. 9. The purpose served by this particular combination of shapes can be seen by reference to FIGS. 9, 11, and 13 showing, in degrees, the lower clamping member 14*b* being pivoted up into position against the knife 12, to clamp the knife.

Figure 10:
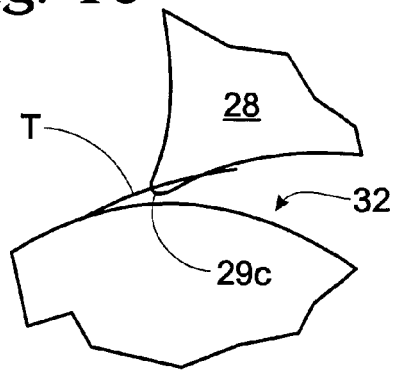
FIG. 10 is a detail circle referenced as 10—10 in FIG. 9.

In FIG. 9, the lower clamping member 14*b* is being pivoted upwardly, toward the knife 12, and is about to make first contact with the knife, particularly at the apex 29*c* of the deflector ridge 28. FIG. 10 shows the detail circle indicated in FIG. 9. In FIG. 10, a trace "T" is shown of the path of the indexing feature 32 as a result of further upward pivoting of the lower clamping member 14*b*. The trace T foretells an interference that will occur, but has not yet occurred, between the feature 32 and the corresponding indexing feature 30.

Figure 11:
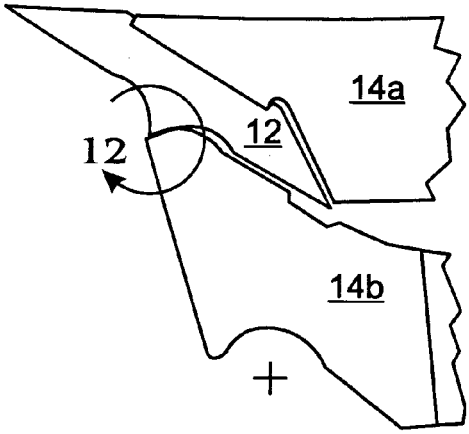
FIG. 11 is a side elevation of the clamp of FIG. 4, showing the lower clamping member pivoted into a position of interference with the knife.
Figure 12:
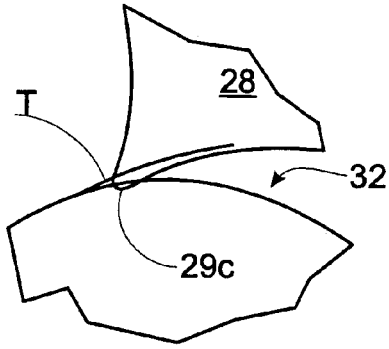
FIG. 12 is a detail circle referenced as 12–12 in FIG. 11.

FIGS. 11 and 12, corresponding to FIGS. 9 and 10 respectively, show this interference more explicitly, by showing the relative positions of these features in the case that further upward pivoting of the lower clamping member 14*b* toward the knife 12 has occurred. The interference is shown by an overlapping of the indexing features 30 and 32 that, as will be readily appreciated, cannot physically occur.

Figure 13:
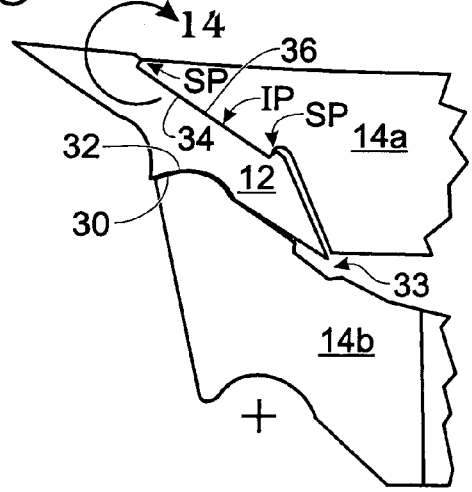
FIG. 13 is a side elevation of the clamp of FIG. 4, showing the lower clamping member pivoted as in FIG. 5, resolving the interference of FIG. 11.

FIG. 13 shows the final progression of pivoting of the lower clamping member 14*b* into position against the knife, for clamping the knife in place. For the indexing features 30 and 32 to reach the relative positions shown in FIG. 13 from those shown in FIG. 11, the knife must first yield the small amount necessary to accommodate the interference shown in FIGS. 11 and 12. Such yielding occurs for two reasons. First, there is some compliance in the deflector ridge 28. Second, there is a slight readjustment of the contact that the back side 12*a* of the knife makes with the upper clamping member 14*a* as the knife settles into a stable position.

The capability for readjustment of the contact between the back side 12*a* of the knife and the upper clamping member 14*a* depends on the geometry of these parts. Preferably, with reference to FIG. 13 for example, the upper clamping member 14*a* includes a projection 34 that is shaped to fit a recess 36 in the back side 12*a* of the knife 12, to index the knife to the upper clamping member, though the shapes of these features could be reversed, i.e., the projection 34 could be replaced with a recess where the recess 36 is replaced with a corresponding projection.

Figure 14:
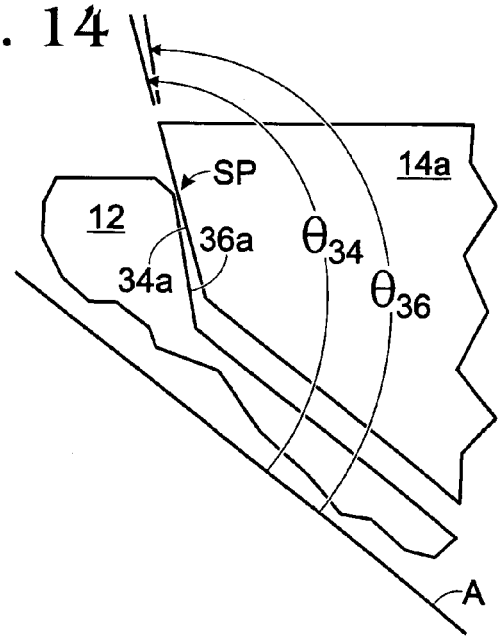
FIG. 14 is the detail circle referenced as 14—14 in FIG. 13.

FIG. 14 shows the detail circle indicated in FIG. 13. Preferably, the projection 34 and the recess 36 have complementary canted sides 34*a*, 36*a* that describe respective obtuse angles θ, namely $\theta_{34}$, $\theta_{36}$, relative to the afore-described plane A, where $\theta_{34}>\theta_{36}$. This relationship between the angles θ ensures that contact will be made at widely spaced apart points "SP" rather than intermediate points such as the point "IP." It may also be appreciated that this manner of providing interfering contact between the projection 34 and the recess 36 allows for some movement of the knife (a combination of linear movement parallel to the plane A and rotation) and, such as described above, before the knife settles into its final stable position as shown in FIG. 13.

The position of the knife 12 relative to the lower clamping member 14*b* as shown in FIG. 13 is stable because the apex 29*c* of the deflector ridge 28 has traveled "over center" with respect to, or "cammed over" the indexing feature 32 of the lower clamping member. The smoothly varying contour C is preferably and most simply a circular arc as indicated in FIG. 8, though a cam-over function could be provided by use of an arc shape that is not circular. It is has been determined that in the system as shown the knife 12 can be felt to "snap" into stable position, providing a reliable tactile indication that the knife has been successfully indexed into proper position.

It is to be understood that, while a specific knife assembly and chipping knife therefor has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A knife having an elongate axis and two spaced apart cutting edges parallel to said elongate axis, said cutting edges defining a reference plane, the knife further defined by a plane of reflective symmetry that is perpendicular to said reference plane and which contains said elongate axis, the knife having a front side and a back side spaced from said front side, said front and back sides terminating in said cutting edges, said front and back sides defining a positive direction, perpendicular to said reference plane, running from said back side toward said front side, a deflector ridge projecting from said front side and reaching a first point of greatest maximum projection of the knife in said positive direction, said point lying in said plane of reflective symmetry, and two substantially identical indexing features of said front side disposed on either side of said deflector ridge and corresponding, respectively, to said two cutting edges, each said indexing feature having a second point of minimum projection of said front side in said positive direction and a third point projecting further in said positive direction than said second point but less than said first point, said first, second and third points all lying in a plane that is perpendicular to both said reference plane and said plane of reflective symmetry, said third point being disposed farther from said plane of reflective symmetry than said second point.

2. The knife of claim 1, wherein said back side includes at least one of (a) a recess and (b) a projection, for indexing the knife.

3. The knife of claim 2, wherein said one of(a) and (b) includes canted sides defining an obtuse angle θ with respect to said first reference plane.

4. The knife of claim 3, said front side further including two substantially planar knife-edge-joining portions, each knife-edge-joining portion terminating in one of said cutting edges and the third point of the corresponding indexing feature.

5. The knife of claim 4, wherein said knife-edge-joining portions are substantially co-planar.

6. The knife of claim 5, wherein said knife-edge-joining portions lie substantially in said reference plane.

7. The knife of claim 2, said front side further including two substantially planar knife-edge-joining portions, each knife-edge-joining portion terminating in one of said cutting edges and the third point of the corresponding indexing feature.

8. The knife of claim 7, wherein said knife-edge-joining portions are substantially co-planar.

9. The knife of claim 8, wherein said knife-edge-joining portions lie substantially in said reference plane.

10. The knife of claim 1, wherein said indexing features define substantially circular arcs.

11. The knife of claim 10, wherein said back side includes at least one of (a) a recess and (b) a projection, for indexing the knife.

12. The knife of claim 11, wherein said one of (a) and (b) includes canted sides defining an obtuse angle θ with respect to said first reference plane.

13. The knife of claim 12, said front side further including two substantially planar knife-edge-joining portions, each knife-edge-joining portion terminating in one of said cutting edges and the third point of the corresponding indexing feature.

14. The knife of claim 13, wherein said knife-edge-joining portions are substantially co-planar.

15. The knife of claim 14, wherein said knife-edge-joining portions lie substantially in said reference plane.

16. The knife of claim 11, said front side further including two substantially planar knife-edge-joining portions, each knife-edge-joining portion terminating in one of said cutting edges and the third point of the corresponding indexing feature.

17. The knife of claim 16, wherein said knife-edge-joining portions are substantially co-planar.

18. The knife of claim 17, wherein said knife-edge-joining portions lie substantially in said reference plane.

19. The knife of claim 10, said front side further including two substantially planar knife-edge joining portions, each knife-edge-joining portion terminating in one of said cutting edges and the third point of the corresponding indexing feature.

20. The knife of claim 19, wherein said knife-edge-joining portions are substantially co-planar.

21. The knife of claim 20, wherein said knife-edge-joining portions lie substantially in said reference plane.

22. The knife of claim 1, said front side further including two substantially planar knife-edge-joining portions, each knife-edge-joining portion terminating in one of said cutting edges and the third point of the corresponding indexing feature.

23. The knife of claim 22, wherein said knife-edge-joining portions are substantially co-planar.

24. The knife of claim 23, wherein said knife-edge-joining portions lie substantially in said reference plane.

25. A knife assembly, comprising:

an upper clamping member adapted to receive said back side of the knife;

a lower clamping member adapted to receive said front side of the knife, said upper and lower clamping members for clamping the knife therebetween; and a knife having an elongate axis and two spaced apart cutting edges parallel to said elongate axis, said cutting edges defining a reference plane, the knife further defined by a plane of reflective symmetry that is perpendicular to said reference plane and which contains said elongate axis, the knife having a front side and a back from said front side, said front and back sides terminating in said cutting edges, said front and back sides defining a positive direction, perpendicular to said reference plane, running from said back side toward said front side, a deflector ridge projecting from said front side and reaching a first point of greatest maximum projection of the knife in said positive direction, said point lying in said plane of reflective symmetry, and two substantially identical indexing features of said front side disposed on either side of said deflector ridge and corresponding, respectively, to said two cutting edges, each said indexing feature having a second point of minimum projection of said front side in said positive direction and a third point projecting further in said positive direction than said second point but less than said first point, said first, second and third points all lying in a plane that is perpendicular to both said reference plane and said plane of reflective symmetry, said third point being disposed farther from said plane of reflective symmetry than said second point.

26. The knife assembly of claim 25, further comprising a base, said lower clamping member for disposition between said upper clamping member and said base and adapted for pivotal movement about said base relative to said upper clamping member.

27. The knife assembly of claim 26, wherein said back side and said upper clamping member include at least one of (a) a recess and a projection, and (b) a projection and a recess, respectively, for indexing said knife to said upper clamping member, wherein said one of (a) and (b) includes canted sides defining obtuse angles $\theta_1$ and $\theta_2$ with respect to said first reference plane and corresponding, respectively, to said projection and said recess, where $\theta_1 > \theta_2$.

28. The knife assembly of claim 26, said front side further including two substantially planar knife-edge-joining portions, each knife-edge-joining portion terminating in one of said cutting edges and the third point of the corresponding indexing feature.

29. The knife assembly of claim 28, wherein said back side and said upper clamping member include at least one of (a) a recess and a projection, and (b) a projection and a recess, respectively, for indexing said knife to said upper clamping member, wherein said one of (a) and (b) includes canted sides defining obtuse angles $\theta_1$ and $\theta_2$ with respect to said first reference plane and corresponding, respectively, to said projection and said recess, where $\theta_1>\theta_2$.

30. The knife assembly of claim 26, wherein said indexing features define substantially circular arcs.

31. The knife assembly of claim 30, wherein said back side and said upper clamping member include at least one of (a) a recess and a projection, and (b) a projection and a recess, respectively, for indexing said knife to said upper clamping member, wherein said one of (a) and (b) includes canted sides defining obtuse angles $\theta_1$ and $\theta_2$ with respect to said first reference plane and corresponding, respectively, to said projection and said recess, where $\theta_1>\theta_2$.

32. The knife assembly of claim 30, said front side further including two substantially planar knife-edge-joining portions, each knife-edge-joining portion terminating in one of said cutting edges and the third point of the corresponding indexing feature.

33. The knife assembly of claim 32, wherein said back side and said upper clamping member include at least one of(a) a recess and a projection, and (b) a projection and a recess, respectively, for indexing said knife to said upper clamping member, wherein said one of (a) and (b) includes canted sides defining obtuse angles $\theta_1$ and $\theta_2$ with respect to said first reference plane and corresponding, respectively, to said projection and said recess, where $\theta_1>\theta_2$.

34. The knife assembly of claim 25, wherein said indexing features define substantially circular arcs.

35. The knife assembly of claim 34, wherein said back side and said upper clamping member include at least one of (a) a recess and a projection, and (b) a projection and a recess, respectively, for indexing said knife to said upper clamping member, wherein said one of (a) and (b) includes canted sides defining obtuse angles $\theta_1$ and $\theta_2$ with respect to said first reference plane and corresponding, respectively, to said projection and said recess, where $\theta_1>\theta_2$.

36. The knife assembly of claim 34, said front side further including two substantially planar knife-edge-joining portions, each knife-edge-joining portion terminating in one of said cutting edges and the third point of the corresponding indexing feature.

37. The knife assembly of claim 36, wherein said back side and said upper clamping member include at least one of (a) a recess and a projection, and (b) a projection and a recess, respectively, for indexing said knife to said upper clamping member, wherein said one of (a) and (b) includes canted sides defining obtuse angles $\theta_1$ and $\theta_2$ with respect to said first reference plane and corresponding, respectively, to said projection and said recess, where $\theta_1>\theta_2$.

* * * * *